US007073628B2

(12) United States Patent
Schmidt

(10) Patent No.: US 7,073,628 B2
(45) Date of Patent: Jul. 11, 2006

(54) DEVICE FOR CLIMBING ON EXTENDED SUPPORTING ELEMENTS, SUCH AS ROPES, WITH RELEASABLE AUTOMATICALLY RECLAMPING CLASPS

(75) Inventor: Siegfried Schmidt, Berlin (DE)

(73) Assignee: Schmidt Innovation, Berlin (DE)

( * ) Notice: Subject to any disclaimer, the term of this patent is extended or adjusted under 35 U.S.C. 154(b) by 181 days.

(21) Appl. No.: 10/775,439

(22) Filed: Feb. 10, 2004

(65) Prior Publication Data

US 2004/0154866 A1 Aug. 12, 2004

Related U.S. Application Data

(63) Continuation of application No. 09/890,495, filed as application No. PCT/DE99/00956 on Sep. 10, 2001, now Pat. No. 6,782,973.

(30) Foreign Application Priority Data

Feb. 3, 1999 (DE) ..... 199 05 257

(51) Int. Cl.
*A62B 27/00* (2006.01)

(52) U.S. Cl. ..... 182/133; 182/142

(58) Field of Classification Search ..... 182/133, 182/134, 142, 5, 192; 188/65.1
See application file for complete search history.

(56) References Cited

U.S. PATENT DOCUMENTS 1,114,832 A 10/1914 Whitney
1,117,800 A * 11/1914 Davidson ..... 182/136
1,754,132 A 4/1930 Van Bekkum
1,964,995 A * 7/1934 McGlaughlin ..... 182/136
3,335,469 A 8/1967 Shand
3,677,367 A * 7/1972 Shotmeyer ..... 182/136
3,926,278 A * 12/1975 Molnar et al. ..... 182/7

FOREIGN PATENT DOCUMENTS

DE 19643455 A1 * 4/1998
DE 19726035 A1 * 12/1998

* cited by examiner

*Primary Examiner*—Alvin Chin-Shue
(74) *Attorney, Agent, or Firm*—Michael J. Striker

(57) ABSTRACT

The device for climbing a pair of ropes (1) includes upper and lower clasps (4,6) for clamping each rope and connecting elements for holding a climber, which include a movable or solid seat (7, 12) or harness (23). Each clasp (4,6) has a housing (21); a yoke (3) in the housing (21) provided with an interior space having beveled inclines widening downward; cotters (10) positioned on opposite sides of the rope (1) in the interior space; rollers (11) arranged movably, but securably, between the cotters (10) and the beveled inclines; a compression spring (20) bearing on an upper end of the yoke (3); and a resilient time servo-component (9) arranged at a lower end of the yoke. The resilient time servo-component (9) acts on the yoke so that the clasp (4,6), when relieved, automatically clamps the rope after a predetermined time interval, thus protecting the climber.

9 Claims, 6 Drawing Sheets

DEVICE FOR CLIMBING ON EXTENDED SUPPORTING ELEMENTS, SUCH AS ROPES, WITH RELEASABLE AUTOMATICALLY RECLAMPING CLASPS

CROSS-REFERENCE TO PRIOR APPLICATION AND CLAIM OF PRIORITY

This application is a cont. of Ser. No. 09/890,495, filed Sep. 10, 2001, U.S. Pat. No. 6,782,972 371 of PCT/DE 99/00958, Mar. 25,1999.

BACKGROUND OF THE INVENTION

1. Field of the Invention

The present invention relates to equipment for climbing a flexible or rigid weight-bearing element, such as rope.

2. Description of the Related Art

Devices for climbing on ropes with grips are known from DE 19726035 A1 and DE 19643455. The disadvantages of the technical solutions provided in these patent applications is that the requirements for greater functional safety and easy ascent and descent for the climbing person can only be attained with great technical effort.

SUMMARY OF THE INVENTION

The task of the present invention is therefore to provide complete functional security and energy-saving climbing, especially for persons on the ropes or rigid structures.

According to one aspect of the present invention the device for climbing at least one flexible or rigid weight-bearing element, such as a rope, comprises releasable clasps each including means for clamping the at least one weight-bearing element in response to a downward force acting thereon and means for releasing the at least one weight-bearing element when the downward force is relieved; and connecting means attached to the clasps for holding the climber so that he or she is able to apply and relieve the downward force by shifting his or her weight;

wherein each clasp includes a time servo-component acting on the means for clamping the at least one weight-bearing element to again clamp the at least one weight-bearing element when a predetermined time interval starting from relief of the downward pressure expires.

In various embodiments of the invention the time servo-component is an elastic rubber member, a hydraulic spring or a pneumatic spring and the means for clamping the at least one weight-bearing element comprises inclined bevels or a yoke that responds to the time servo-component so that the clasp associated with the time servo-component releases.

In preferred embodiments of the invention the clasps include at least one upper clasp and at least one lower clasp. The lower clasp or clasps are arranged below the upper clasp or clasps on the at least one weight-bearing element.

In some embodiments the connecting means includes a solid seat and the at least one upper clasp is located at the solid seat. Preferably the at least one weight-bearing element consists of two ropes. Frame handles associated with each rope are attached to opposite sides of the solid seat. Guide wheels are provided at upper ends of the frame handles over which the ropes are guided. A tension spring is arranged between the respective lower and upper clasp for each rope through which it passes to the feet of the climber. Pedal levers are pivotally attached to the bottom ends of the frame handles and connected with the upper clasps so as to be able to release them.

In other embodiments of the device the connecting means for holding the climber includes at least one system belt and a movable seat, which is attached to the at least one upper clasp by the at least one system belt, so that a connection between the movable seat and the at least one upper clasp is pressure-stable in a longitudinal direction of the at least one system belt. The at least one system belt is preferably form-locked in the at least one upper clasp so that the at least one system belt cannot slip out of the at least one upper clasp. The at least one lower clasp preferably includes the yoke and a pulling element attached to it, which comprises manual means for releasing the downward pressure. In these preferred embodiments tension springs are arranged between the movable seat and the at least one lower clasp and additional tension springs are arranged between the movable seat and the at least one upper clasp, the at least one weight-bearing element passing through the tension springs.

In its preferred form each clasp includes a housing; the yoke mounted in the housing and provided with an interior space having inner contours with beveled inclines widening downward in the inner space; cotters positioned on opposite sides of the at least one weight-bearing element in the inner space; rollers arranged movably, but securably, between cotters and inner contours of the yoke; a compression spring bearing on an upper end of the yoke; and the time servo-component arranged at a lower end of the yoke.

When the clasp has this preferred form, the connection means can comprise a movable seat, at least one system belt attaching the movable seat to the housing of the at least one upper clasp, at least one safety line attached to the housing of the at least one upper clasp and tension springs connected between the seat and the at least one lower clasp, at least one handle grip attached to the at least one upper clasp and a rod on which foot holders are mounted attached to the at least one lower clasp, the rod being attached to the at least one lower clasp in a swiveling and form-locking manner.

In a special embodiment according to the invention the device for climbing at least one flexible or rigid weight-bearing element includes releasable clasps each comprising means for clamping the at least one weight-bearing element in response to a downward force acting thereon and means for releasing the at least one weight-bearing element when the downward force is relieved; and connecting means associated with each clasp for holding the climber so that the climber is able to apply and relieve the downward force. Each clasp comprises a time servo-component acting on the means for clamping the at least one weight-bearing element to again clamp the at least one weight-bearing element when a predetermined time interval starting from relief of the downward pressure expires. The clasps each comprise cotters arranged in an interior space provided in the yoke on opposite sides of the at least one weight-bearing element. Each clasp is provided with a draw element connected with the yoke for manually lifting the yoke to release the cotters so that the cotters do not bear on the at least one weight-bearing element. Each clasp preferably has a rotatable slotted sleeve on an end thereof for locking the clasp.

The device for climbing according to the invention has the special advantage that it meets the ergonomic requirements and with their aid it is possible to use the power of the entire body to climb. It is even suitable for inexperienced climbers and it is easy to learn to handle. It is useful for leisure-time activity and sports as well as for rescue and salvage operation and for repair work, cleaning and other work on facades and buildings. The climbing device according to the invention guarantees a high degree of working safety, which is even provided with some improper use.

BRIEF DESCRIPTION OF THE SEVERAL VIEWS OF THE DRAWING

The objects, features and advantages of the invention will now be illustrated in more detail with the aid of the following description of the preferred embodiments, with reference to the accompanying figures in which.

DETAILED DESCRIPTION OF THE INVENTION

Figure 1:
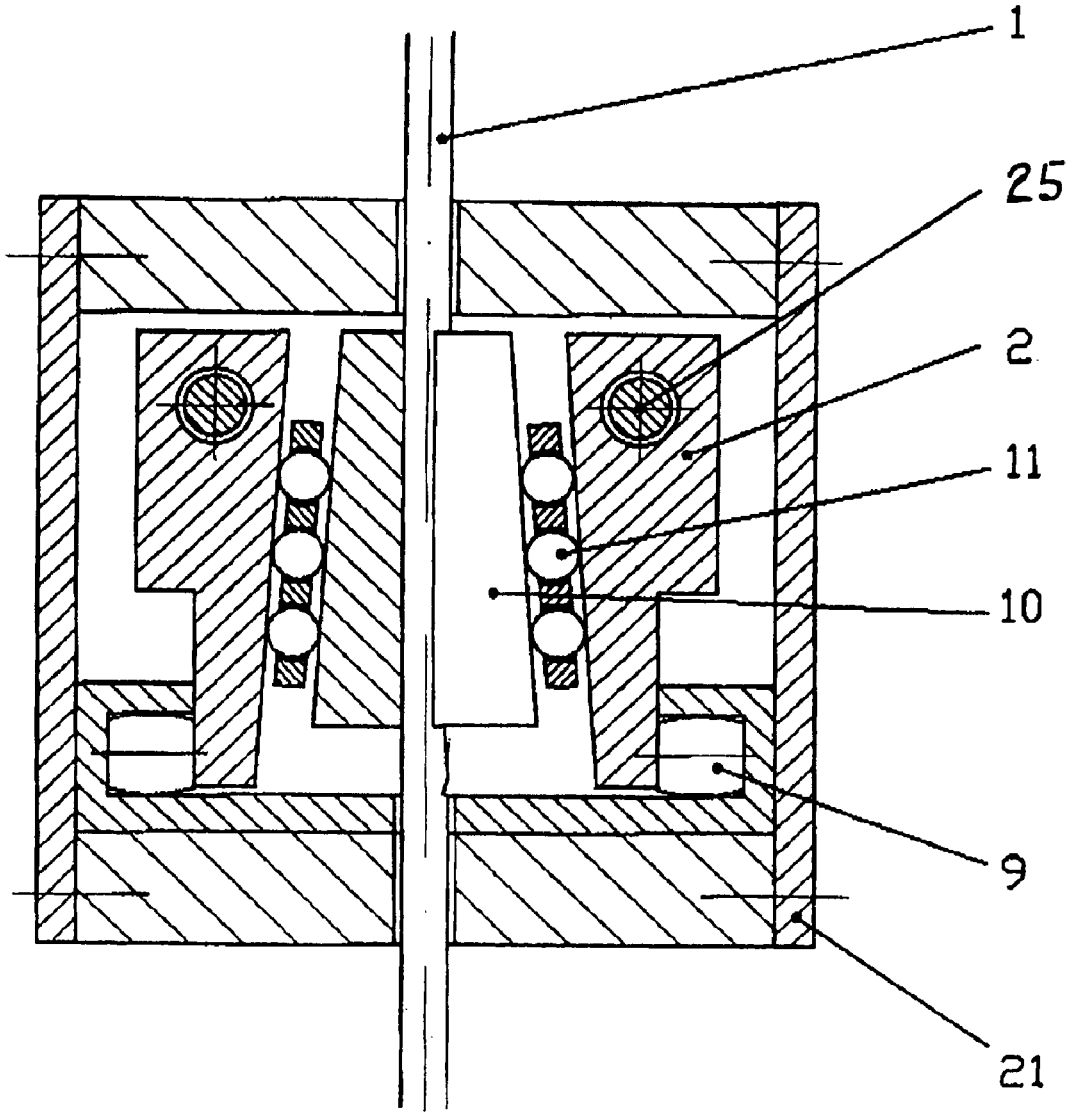
FIG. 1 is a detailed vertical cutaway cross-sectional view through a clasp for a device for climbing according to a first embodiment of the invention, showing only the principal parts of the clasp.

One form of a clasp for the climbing device, shown in FIG. 1, comprises a housing 21 with pivotable inclined bevels 2 mounted in it together with movable cotters 10 and rollers 11. In the housing 21 of FIG. 1 the inclined bevels 2 are arranged so that they can pivot on pivots 25 located in a top portion of the bevels. Elastomeric servo-components 9 press against the bottoms of the inclined bevels 2. Between the inclined bevels 2 and the cotter 10 there are rollers 11. At a prescribed height the rollers 11 press the cotters 10 against the rope 1 as a result of the geometric shape of the inclined bevels 2, whereby the time servo-component 9 is compressed. In this configuration the cotters 10 clamp onto the rope. The moving of the clasp is made possible by lifting the clasp by its housing 21 thereby releasing the rollers 11 and thus the cotters 10, which move back and disengage from the rope 1. The free movement of the device along the rope 1 is then possible until the time servo-components 9 have assumed their original form and again act to press the cotters 10 against the rope via the incline bevels 2 and rollers 11. Then the climbing process can start again.

Figure 2A:
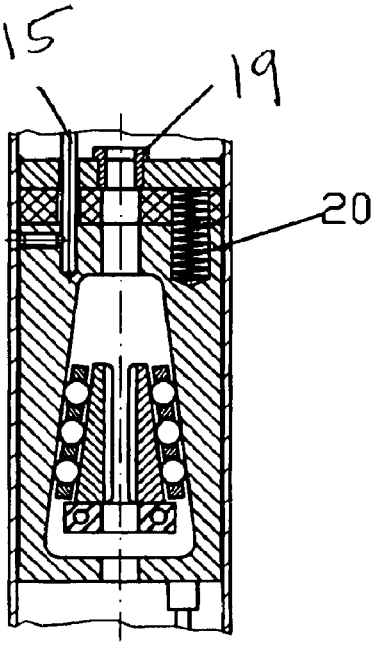
FIG. 2*a* is detailed cutaway cross-sectional view through a preferred form for a clasp from a second embodiment of a device for climbing according to the invention, which has a different structure from the clasp shown in FIG. 1.
Figure 2B:
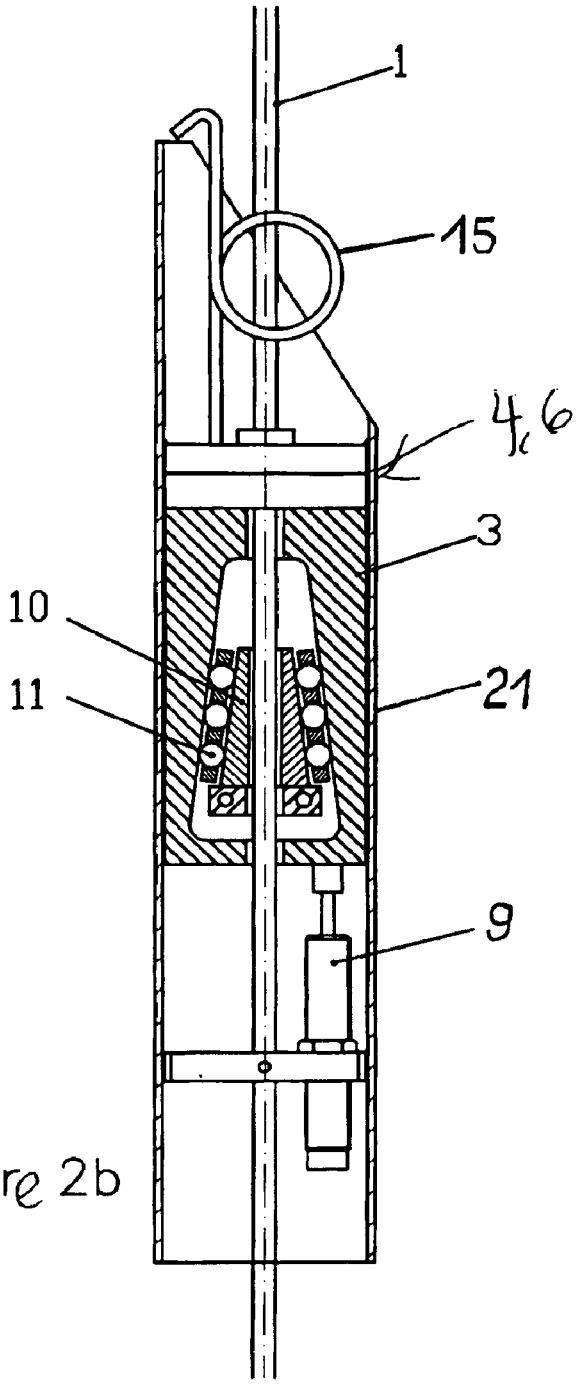
FIG. 2*b* is a detailed cross-sectional view through the entire clasp shown in FIG. 2*a;*

Another form of the clasp 4,6 is shown in FIGS. 2*a* and 2*b*. Parts that perform similar functions as in the embodiment of FIG. 1 are given the same reference numbers. The clasp 4,6 has housing 21. Instead of inclined bevels 2 it has a yoke 3 that is slidable in the housing 21. As in the embodiment of FIG. 1, cotters 10 engage and disengage from the rope 1. Rollers 11 are arranged between the cotters 10 and the yoke 3. The yoke 3 has an interior cavity that widens downward that has inner contours with beveled inclines. When the clasp clamps on the rope, the rollers 11 bear on the outer surfaces of the cotters 10 and the inner contours of the yoke 3 forcing the cotters 10 against the rope 1. A pulling element 15 is connected to the top of the yoke 3. A hydraulic or pneumatic cylinder bears on the bottom of the yoke 3 and acts as the time servo-component 9. A compressed spring 20 urges the yoke 3 downward into a clamping configuration.

Figures 3A, 3B, 3C:
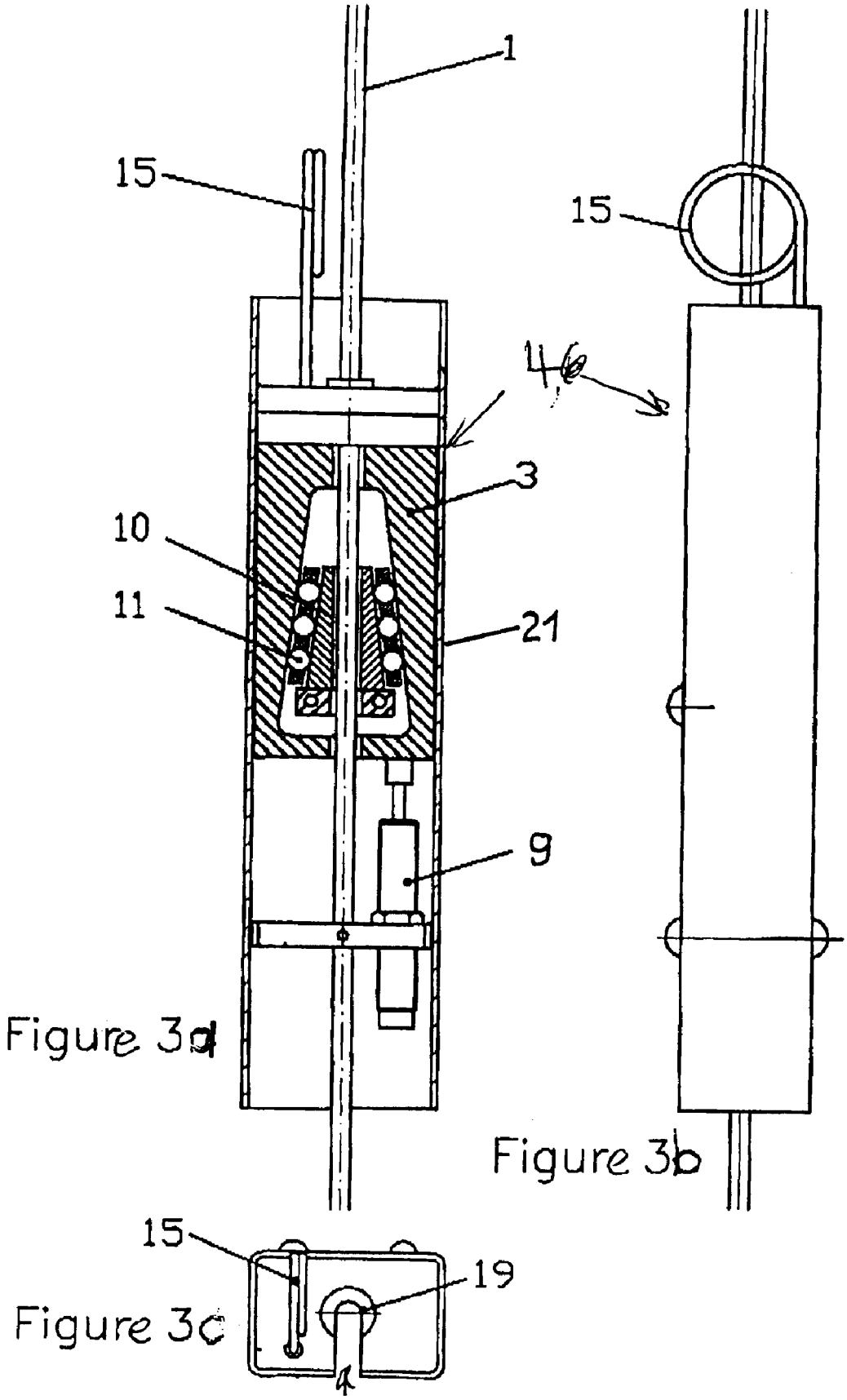
FIG. 3*a* is detailed cross-sectional view through another preferred form for a clasp from a third embodiment of a device for climbing according to the invention.
FIG. 3*b* is a side view of the entire clasp shown in FIG. 3*a;*
FIG. 3*c* is a top plan view of the clasp shown in FIGS. 3*a* and 3*b;*

The embodiments of the clasp 4,6 shown in FIGS. 3*a*, 3*b*, and 3*c* is the same as the embodiment of FIGS. 2*a* and 2*b*, except that the pulling element 15 is formed slightly differently. A sleeve 19 is provided on the clasp, as shown in FIGS. 3*a* and 3*c*.

The structure and operation of various embodiments of the entire climbing device according to the invention are now explained.

Figure 4:
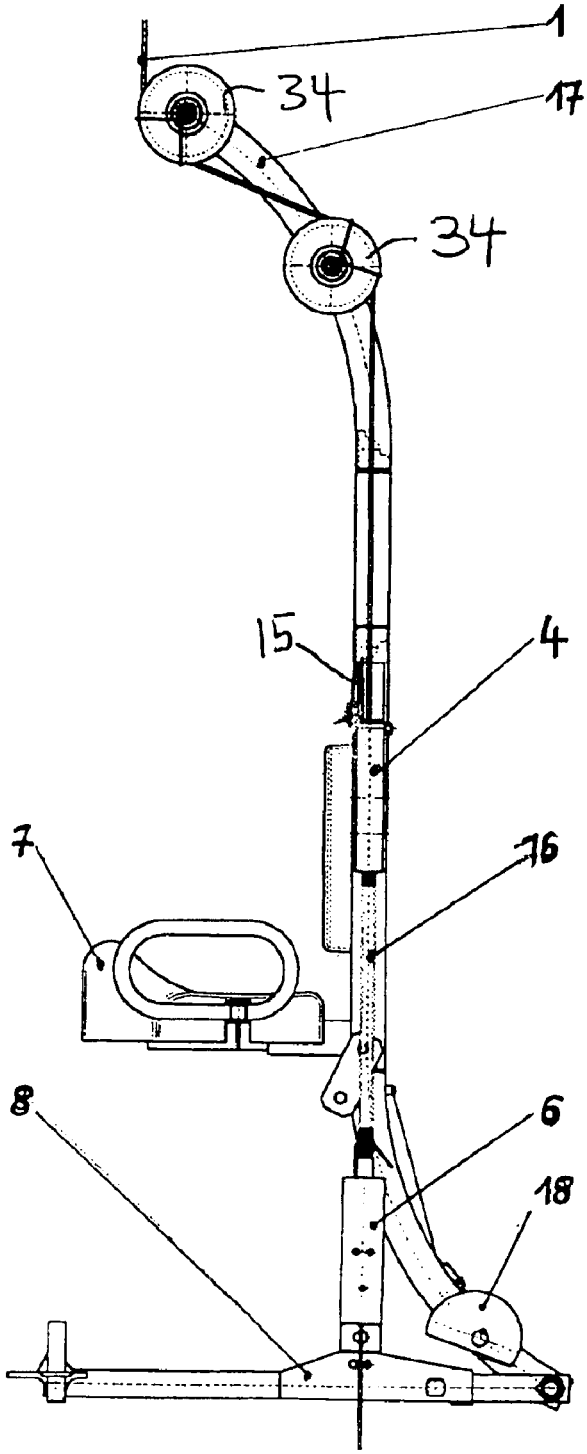
FIG. 4 is a side view of the entire device for climbing according to a preferred embodiment of the invention.

The embodiment of the device for climbing in FIG. 4 comprises a solid seat 7, frame handles 17 attached to opposite sides of the solid seat 7, respective upper clasps 4 (embodiment of FIG. 2*b*) attached to corresponding frame handles 17 near or at the solid seat 7, guide wheels 34 attached to upper parts of the frame handles 17, respective ropes 1 passing over the guide wheels and through the upper clasps 4, respective pedal levers 8, respective lower clasps 6 attached to the pedal levers 8 and through which the rope 1 also passes and compression springs 16 connecting the upper and lower clasps with each other. The frame handles 17 also have joints in the vicinity of the solid seat 7 and rotatable cams 18 are connected to the frame handles 17 between the pivots and the joints. The pedal levers 8 are connected to the pulling elements 15 for the upper clasps, whereby the upper clasps are operable by the pedal levers.

FIG. 4 shows a climbing device, which] could be used to rescue persons. The basis for the climbing motion is the moving characteristic of clasps 4 and 6. If a force acts downwards on clasps 4 and 6 (the clasp is burdened with the weight of the climbing person, for instance), the ropes 1, here the weight-bearing element, is then clamped in clasps 4 and/or 6. If one of the clasps, either 4 or 6, is relieved of the downward acting force, it can be moved along its rope 1.

The upward climb is therefore performed as follows.

The two lower clasps 6 are first clamped in the two ropes 1 by the downnward weight of the climbing device and the person. By pressing the two pedal levers 8 downward the two upper clasps 4 are released, their time servo components 9 are activated, and they are moved upward together with the climbing device along rope 1. If then the pedal levers 8 are released and the weight is put on the solid seat 7, the upper clasps 4 clamp down on the rope as a result of the downward force.

If the pedal levers 8 are released, the recuperating spring 16 pulls the pedal levers 8 upward. This then releases the two lower clasps 6 and the restoring springs 16 move upward on ropes 1. The time servo-components 9 in the lower clasps 6 are activated with each release.

If the pedal levers 8 have returned to their initial position, the lower clasps 6 again clamp on the ropes 1 after the delay for reaction of the time servo-component 9 is concluded. The entire cycle can commence once again.

Descent is performed as follows.

The time servo-component 9 of the invention is also decisive for descent. In this example they function as shock absorbers in clasps 4 and 6. If the weight is released from clasps 4 and 6, they only re-clamp on ropes 1 after a short delay. During this short delay the climbing device and the user descend. The pedal levers 8 are briefly released and then pressed downward. Within the above-mentioned short delay the lower clasps 6 move downward with the pedal levers 8 along ropes 1 and then clamp down on ropes 1. Thereafter the upper clasps 4 are briefly released. Within the short period of time caused by the delay from the time servo-component the upper clasps 4 and therefore the seat 7 as well can move downward.

The clamping grip on the rope can be released by the upward movement of the clasp, which relieves downward force on the clasp. As in the embodiments shown in FIGS. 2*a* and 2*b* and 3*a* and 3*b*, a short lifting of the yoke 3, e.g. by pulling element 15, is sufficient to release the pressure between the parts of the clasp. Needle cages for the rollers 11 and cotters 10 fall downward through their own weight in the component and the clasp is open.

The embodiments of FIGS. 5 and 6 have a movable seat 12 or merely a harness 23 and are designed for fast climbing.

Figure 5A:
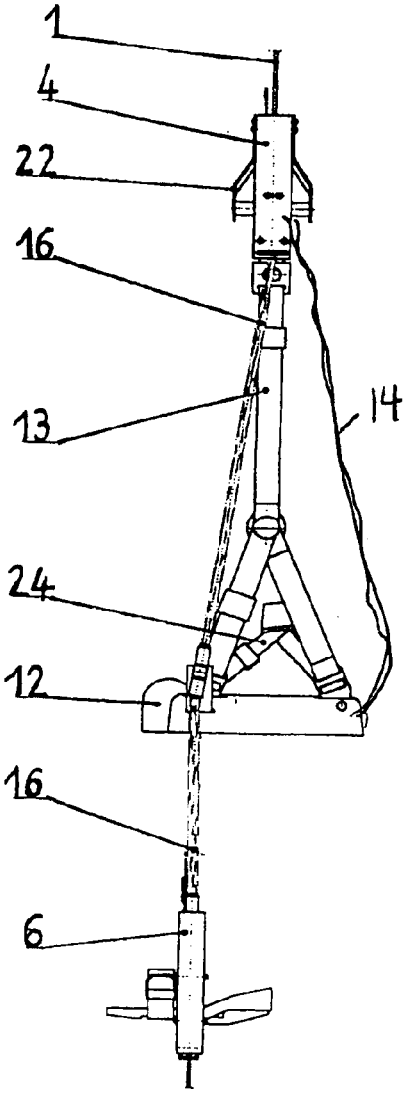
FIGS. 5*a* and 5*b* are, respectively, a side view and a front view of another embodiment of the entire device for climbing according to the invention.
Figure 5B:
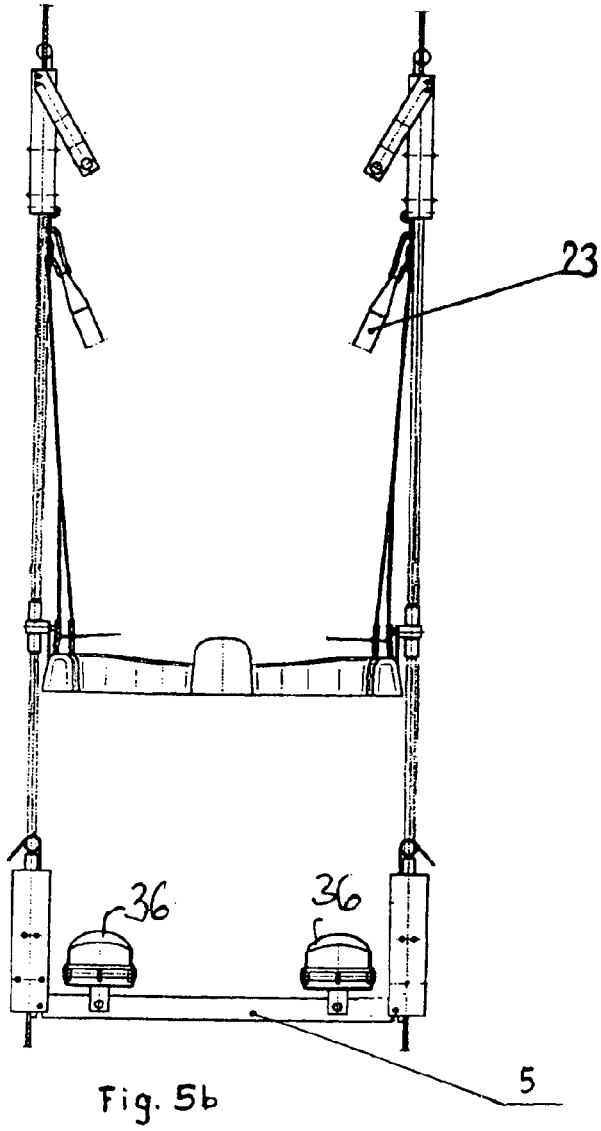

In the embodiment of FIGS. 5*a* and 5*b* connecting means for holding the climber includes system belts 13 and a movable seat 12, which is attached to the two upper clasps 4 engaged on two ropes 1 by the system belts 13, so that a connection between the movable seat and the upper clasps is pressure-stable in a longitudinal direction of the system belts 13. The system belts are preferably form-locked in the upper clasps so that the system belts cannot slip out of the upper clasps. In these preferred embodiments tension springs 16 are arranged between the movable seat 12 and the lower clasps and additional tension springs 16 are arranged between the movable seat 12 and the upper clasps. The ropes 1 pass through the tension springs 16. There are no supporting handle frames as in the previous embodiment of FIG. 4.

Safety ropes 14 can connect the upper clasps 4 and the seat 12. Handle grips 22 can be provided on the upper clasps 4. The lower clasps 6 are mounted on opposite ends of swiveling rod 5 and foot holders 36 are mounted on the swiveling rod.

Slits have been made in the housings of the upper clasps 4 in which form-locking connecting elements are hooked to which the system belts 13 are attached. The safety ropes 14 are hooked in the above-mentioned connecting elements, whereby an unintentional release of the above-mentioned connecting elements from the clasps 4 can be hindered.

The seat 12 is provided with seatbelt 24, which is attached to the lower ends of the system belts 13. The tension springs 16 are attached with their outer ends to the clasps 4 and 6 and with the inside ends to the seat 12. The rod 5 with the foot holders 36 is hung, form-locked, in the lower clasps 6.

A stay-bar, which is not shown, assures the required distance for climbing, for instance to the building.

DESCRIPTION OF THE OPERATION OF THIS EMBODIMENT

The climbing person straps on the harness 23 and hooks the safety ropes 14 in the above-mentioned connecting elements. In this way the person is protected from a fall. The seatbelt 24 is then closed and the feet inserted in the foot holders 36 of the rod 5.

The force goes from the seat 12 through the system belts 13 and the closed upper clasps 4 to the ropes 1.

When climbing the lower clasps 6 are moved upwards by means of the rod 5 with the aid of the lower tension springs 16 after briefly weighting them. In this position the time servo-components 9 gives the impulse to close the lower clasps 6.

The climber can then shift their weight to the rod 5, stand up and push the upper clasps 4 upwards against the pull of the upper tension springs 16. Then the climber can sit down again and repeat the procedure again.

When descending the lower clasps 6 are pushed downwards until the legs are almost completely extended, as described above, after a short weighting and unweighting.

After clamping the lower clasps 6, the climber stands up and unweights the upper clasps 4 with their hands—thus releasing them—and then moves the clasps to shoulder height. After automatically clamping of the upper clasps 4 by means of the time servo-components 9, the climber sits and the procedure can be repeated again.

If the connection between the seat 12 and upper clasps 4 in the system belts is pressure-stable, the clasps 4 will, as described above, be pushed upwards without the use of the hands when the climber stands up.

Instead of the rod 5 it is possible to attach the clasps 6 directly to the shoes of the climber in a suitable manner, thus allowing an alternative climbing.

Figure 6A:
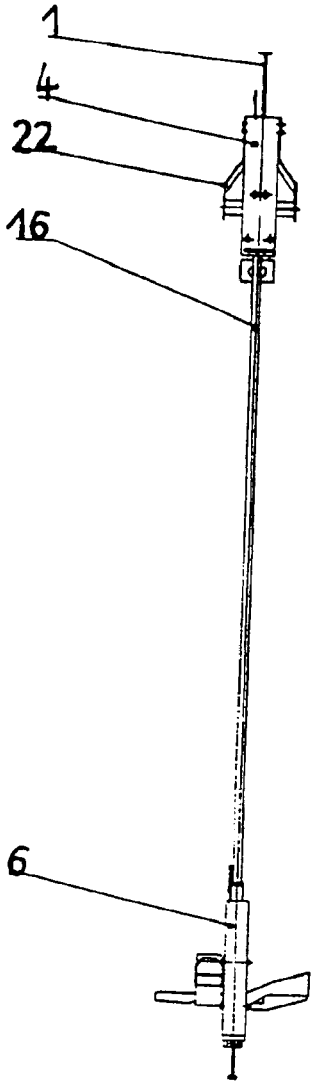
FIGS. 6*a* and 6*b* are, respectively, a side view and a front view of an additional embodiment of the entire device for climbing according to the invention, which has a harness for holding the user instead of a seat.
Figure 6B:
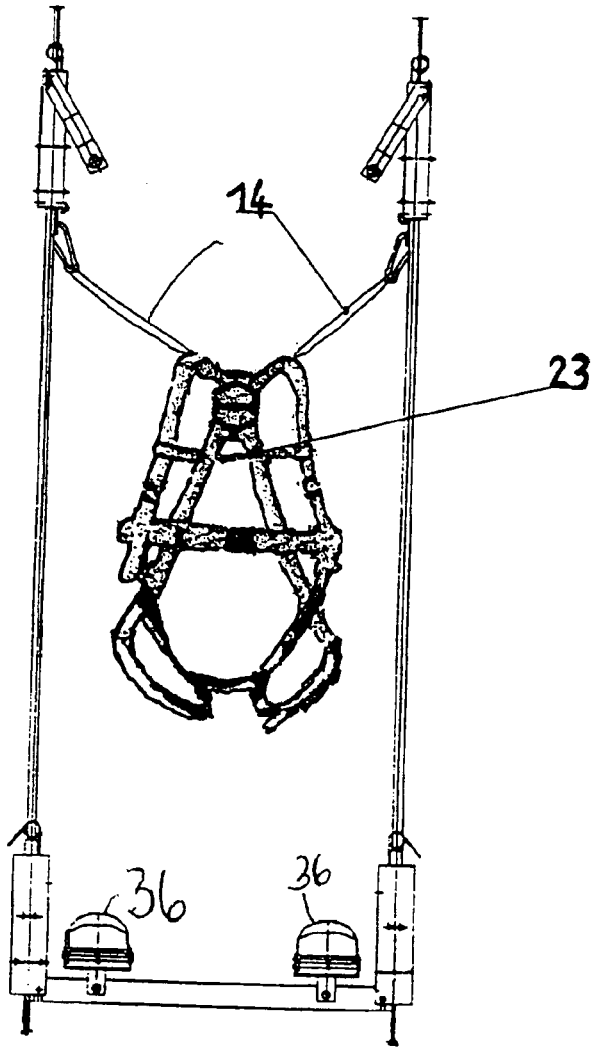

The embodiment shown in FIGS. 6*a* and 6*b* is similar to the embodiment shown in FIGS. 5*a* and 5*b*. Instead of the movable seat 12, only a harness 23 is provided, which is connected with the upper clasps 4 by means of safety lines 14. Also only a single spring 16 connects the upper clasp 4 on one rope to its associated lower clasp 6 and the rope runs through it. This embodiment also has two ropes.

The lower clasps are connected with each other with swiveling rod 5 that accommodates the foot holders 36, as in the previous embodiment.

In this variation a harness is to be selected that has shoulder rings and allows sitting. To stabilize the climber the safety rope 14 is attached to the back ring of the harness 23 and led through the shoulder rings of the harness.

The climbing device has the advantage of being able to be employed in many different ways.

It is useful for leisure-time activity and sports as well as for rescue and salvage operation whether in the mountains or for the fire department. The climbing device is particularly advantageous for repair work, cleaning and other work on facades and buildings.

What is claimed is:

1. A climbing device for a climber climbing or descending at least one weight-bearing element (1), said device comprising releasable clasps (4, 6) each comprising means for clamping said at least one weight-bearing element (1) in response to a downward force acting thereon and means for releasing said at least one weight-bearing element (1) when said downward force is relieved; and connecting means (7, 8; 17) attached to said clasps (4,6) for holding and supporting said climber so that said climber is able to apply and relieve said downward force;

wherein each of said clasps comprises a resilient time servo-component (9) acting on said means for clamping said at least one weight-bearing element to again clamp said at least one weight-bearing element (1) when a predetermined time interval starting with relief of said downward pressure expires, wherein said resilient time servo-component is an elastic rubber member, a hydraulic spring or a pneumatic spring and said means for clamping said at least one weight-bearing element comprising inclined bevels pivotably mounted in said housing and forming an interior space widening downward; cotters positioned on opposite sides of said at least one weight-bearing element in between said inclined bevels; rollers arranged movably, but securably, between said cotters and said inclined bevels in said interior space; wherein said inclined bevels are connected to said resilient time servo-component so that said inclined bevels respond to said time servo-component when said time servo-component acts on said means for clamping.

2. The device as defined in claim 1, wherein said clasps (4,6) for said at least one weight-bearing element (1) comprise at least one upper clasp (4) and at least one lower clasp (6) and said at least one lower clasp (6) is arranged on said at least one weight-bearing element below said at least one upper clasp (4).

3. The device as defined in claim 2, wherein said connecting means includes a solid seat (7) and said at least one upper clasp (4) is located at said solid seat (7).

4. The device as defined in claim 2, wherein said connecting means includes a system belt (13) and a movable seat (12), said movable seat (12) being attached to said at least one upper clasp (4) by means of said system belt (13), so that a connection between said movable seat and said at least one upper clasp (4) is pressure-stable in a longitudinal direction of said system belt.

5. The device as defined in claim 4, wherein said system belt (13) is form-locked in said at least one upper clasp (4), so that said system belt cannot slip out of said at least one upper clasp.

6. The device as defined in claim 4, further comprising at least one tension spring (16) arranged between said movable seat (12) and said at least one lower clasp (6) and at least one other tension spring (16) arranged between said movable seat (12) and said at least one upper clasp (4), and wherein said at least one weight-bearing element (1) passes through said at least one tension spring (16) and said at least one other tension spring (16).

7. The device as defined in claim 6, wherein said at least one weight-bearing element (1) consists of two ropes, and respective ones of said two ropes have corresponding ones of said at least one lower clasp and said at least one upper clasp engaged therewith and are attached to said movable seat (12).

8. The device as defined in claim 3, wherein said at least one weight-bearing element (1) consists of two ropes, respective ones of said two ropes have corresponding ones of said at least one lower clasp and said at least one upper clasp engaged therewith; and further comprising frame handles (17) attached to opposite sides of said solid seat (7), said frame handles having respective joints, pedal levers (8) for feet of said climber pivotally connected to said frame handles at respective pivots and rotating cams (18) connected to said frame handles (17) between said respective pivots and said respective joints.

9. The device as defined in claim 8, further comprising guide wheels (34) attached to said frame handles (17) over which said ropes are guided and tensions springs (16) arranged between the at least one upper clasp (4) and the at least one lower clasp (6) through which said ropes pass to said feet of the climber.

* * * * *